US005243908A

United States Patent [19]

Gilham

[11] Patent Number: 5,243,908

[45] Date of Patent: Sep. 14, 1993

[54] ELECTRONIC FRANKING MACHINE WITH HINGED HOUSING

[75] Inventor: Dennis Gilham, Paris, France

[73] Assignee: Neopost Industrie, Bagneux, France

[21] Appl. No.: 998,051

[22] Filed: Dec. 29, 1992

[30] Foreign Application Priority Data

Dec. 31, 1991 [FR] France ..... 91 16370

[51] Int. Cl.[5] ..... B41F 13/24

[52] U.S. Cl. ..... 101/232; 101/479; 101/91; 271/274

[58] Field of Search ..... 101/91, 93, 93.37, 72, 101/76, 78, 64, 66, 232, 233, 234, 235, 479; 400/693; 271/274

[56] References Cited

U.S. PATENT DOCUMENTS

| | | | |
|---|---|---|---|
| 3,869,981 | 3/1975 | Davis | 101/91 |
| 4,493,252 | 1/1985 | Clark | 101/235 |
| 4,763,575 | 8/1988 | Midukiewicz | 101/235 |
| 4,884,503 | 12/1989 | Nobile | 101/233 |
| 4,953,996 | 9/1990 | Riley et al. | 101/91 |
| 5,165,810 | 11/1992 | Bazzani | 101/479 |
| 5,182,991 | 2/1993 | Patuszynski et al. | 101/91 |
| 5,188,025 | 2/1993 | Murphy, III et al. | 101/91 |

FOREIGN PATENT DOCUMENTS

| | | | |
|---|---|---|---|
| 0298774 | 1/1989 | European Pat. Off. . | |
| 0305211 | 3/1989 | European Pat. Off. . | |
| 2417144 | 9/1979 | France . | |
| 2622325 | 4/1989 | France . | |
| 2142876 | 1/1985 | United Kingdom | 101/91 |

*Primary Examiner*—Eugene H. Eickholt

*Attorney, Agent, or Firm*—Sughrue, Mion, Zinn, Macpeak & Seas

[57] ABSTRACT

An electronic franking machine comprises a franking head, a mail item storage and feed module and a conveyor for feeding individual mail items from the storage and feed module to the franking head. The machine is in two parts comprising a lower part forming a base having a first closing edge and an upper part hinged to the lower part and having a second closing edge. The upper part is adapted to be closed onto the lower part to form a tunnel when the first and second closing edges are in contact extending longitudinally from the storage and feed module to the franking head. The upper part carries a first drive system. The lower part carries a second drive system cooperating with the first drive system to feed a mail item along the tunnel. The drive system constitutes the conveyor. The upper part or the lower part carries the franking head.

1 Claim, 1 Drawing Sheet

ELECTRONIC FRANKING MACHINE WITH HINGED HOUSING

BACKGROUND OF THE INVENTION

1. Field of the Invention

The invention concerns an integrated electronic franking machine. It applies in particular to automatic mail processing systems.

2. Description of the Prior Art

The document EP 298774 discloses an electronic franking machine designed to enable users to frank one or more mail items, usually a very large number of mail items, very quickly by printing on each mail item a stamp representing the amount to be paid by the sender.

FIG. 1 shows an electronic franking machine of this kind comprising an open path 5 defined by two parallel planes between which a mail item is fed. A franking head 8 carried by a base 11 is disposed over the open path to print a stamp on the mail item 7 facing it. The franking head 8 is controlled from a conventional keypad 9 through electronic circuits. This machine is for processing large volumes of mail and further comprises a mail item conveyor. The conveyor comprises rollers and counter-rollers disposed along the open path and rotated in opposite directions to "sandwich" each mail item and feed it to the franking head from a module for storing and feeding mail items to be franked.

The electronic franking machine disclosed in the document EP 298774 has the following drawbacks:

the mail item conveyor and the franking head are noisy in operation, if a jam occurs on the open path the franking machine must be demounted to remove one of the plates defining the open path and free the mail item obstructing it, and it can cause accidents because there is nothing to prevent the operator's hand being trapped in the mail item drive mechanisms, in particular between the rollers and counter-rollers, or from being injured by a mail item moving along the open path.

One object of the invention is to overcome the above drawbacks.

SUMMARY OF THE INVENTION

The invention consists in a electronic franking machine comprising a franking head, a mail item storage and feed module and a conveyor for feeding individual mail items from said storage and feed module to said franking head, which machine is in two parts comprising a lower part forming a base having a first closing edge and an upper part hinged to said lower part and having a second closing edge, said upper part being adapted to be closed onto said lower part to form a tunnel when said first and second closing edges are in contact extending longitudinally from said storage and feed module to said franking head, said upper part carrying first drive means, said lower part carrying second drive means cooperating with said first drive means to feed a mail item along said tunnel, said drive means constituting said conveyor and said upper part or said lower part carrying said franking head.

Because the lower part and the upper part are hinged together it is possible to open the tunnel to obtain direct access to the conveyor mechanisms. When the lower part is open it is easy to free a mail item obstructing the tunnel. The noise caused by operation of the conveyor and the franking head is attenuated, which makes the franking machine more comfortable to use. The risk of accidents when using the machine is very much reduced because the machine is enclosed and the conveyor mechanisms are therefore inaccessible.

Other features and advantages of the invention will emerge more clearly from the following detailed description of one embodiment of an electronic franking machine in accordance with the invention given with reference to the appended drawings.

DETAILED DESCRIPTION OF THE INVENTION

Figure 1:
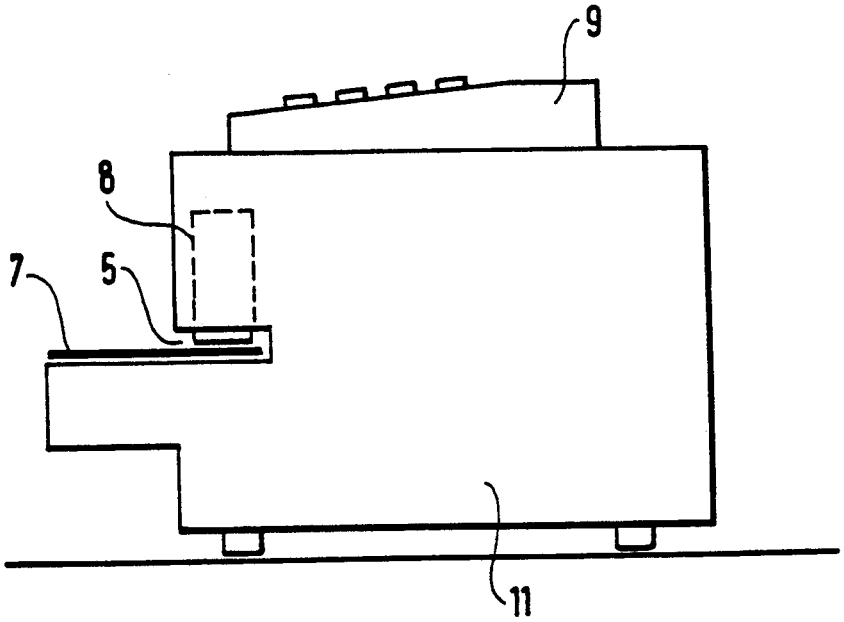
FIG. 1 is a view in elevation of a prior art electronic franking machine.
Figure 2:
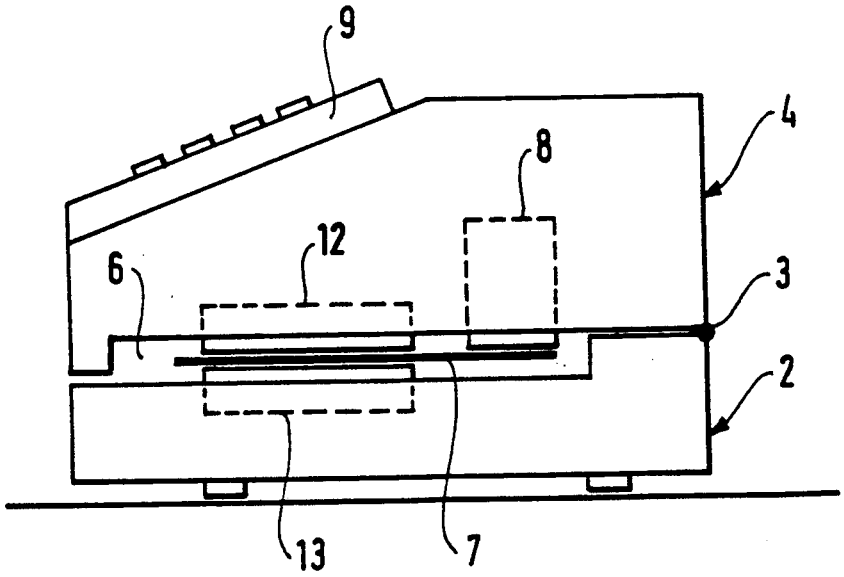
FIG. 2 is a view in elevation of an electronic franking machine in accordance with the invention.

Referring to FIG. 2, the electronic franking machine comprises a lower part 2 forming the base or plinth of the machine and an upper part 4 hinged about an axis 3 to the lower part to form a cover. The two parts each have a closing edge opposite their hinged edge. These cooperate with each other to form a tunnel 6 when the upper part is folded down onto the lower part (as shown in the figure) so that the closing edges of two parts 2 and 4 are in contact, defining a guide path for the mail items 7 to be franked, the tunnel 6 preferably running parallel to the hinge axis 3. The width and height of the tunnel cross-section are chosen to allow for the varied formats and thicknesses of normal mail items. The franking machine further comprises a franking head 8 carried by the lower part 2 or upper part 4. In this example the franking head is carried by the upper part 4 and disposed over the guide path. The franking head may be controlled in the conventional way by a keypad 9 incorporated in the upper part. The machine also comprises a conveyor for feeding individual mail items from a conventional storage and feed module (not shown) to the exit from the franking head. The conveyor has first drive members in the form of rollers 12 carried by the upper part and second drive members in the form of counter-rollers 13 carried by the lower part, the rollers and counter-rollers being rotated in opposite directions in the familiar way. When the lower part is closed by the upper part each mail item inserted between the rollers and the counter-rollers is fed by them to the printing head to be franked. When the lower part is opened by pivoting back the upper part it is easy to access the drive mechanisms to check their condition visually.

The two-part construction of the franking machine in accordance with the invention enables fully automatic mail processing with a high degree of safety in terms of operation and operator protection standards combined with minimal noise and vibration. The longitudinal tunnel forms guide means for the mail items enabling the franking machine to be of modular design, in other words providing the facility to juxtapose a plurality of mail item processing units each comprising an upper part hinged to a lower part. For example, the mail item storage and feed module may be separated from the print module by another integrated module such as an automatic weighing module. In this way it is possible to dispense with manual handling of large format and/or thick mail items. Furthermore, the overall size of the machine can be optimized around and as close as possible to the guide path.

The invention is obviously not limited to the embodiment described hereinabove and other variant implementations are possible without departing from the scope of the invention.

There is claimed:

1. Electronic franking machine comprising a franking head, a mail item storage and feed module and a conveyor for feeding individual mail items from said storage and feed module to said franking head, which machine is in two parts comprising a lower part forming a base having a first closing edge and an upper part hinged to said lower part and having a second closing edge, said upper part being adapted to be closed onto said lower part to form a tunnel when said first and second closing edges are in contact extending longitudinally from said storage and feed module to said franking head, said upper part carrying first drive means, said lower part carrying second drive means cooperating with said first drive means to feed a mail item along said tunnel, said drive means constituting said conveyor and said upper part or said lower part carrying said franking head.

* * * * *